US007823256B2

(12) United States Patent
Engelfried et al.

(10) Patent No.: US 7,823,256 B2
(45) Date of Patent: Nov. 2, 2010

(54) AUXILIARY HANDLE WITH ECCENTRIC CLAMPING LEVER FOR A HAND-HELD POWER TOOL

(75) Inventors: Uwe Engelfried, Ostfildern (DE); Lars Schmid, Nuertingen (DE); Johannes Schnitzler, Reutlingen (DE); Gerhard Meixner, Filderstadt (DE); Jan Koalick, Leinfelden (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/296,572

(22) PCT Filed: Oct. 1, 2007

(86) PCT No.: PCT/EP2007/060375

§ 371 (c)(1),
(2), (4) Date: Oct. 9, 2008

(87) PCT Pub. No.: WO2008/061837

PCT Pub. Date: May 29, 2008

(65) Prior Publication Data

US 2009/0178520 A1 Jul. 16, 2009

(30) Foreign Application Priority Data

Nov. 22, 2006 (DE) ..... 10 2006 055 014

(51) Int. Cl.
*B25G 1/00* (2006.01)

(52) U.S. Cl. ..... 16/426

(58) Field of Classification Search ..... 16/426, 16/421, 422; 81/489, 491; 29/242; 403/83, 403/289, 290

See application file for complete search history.

(56) References Cited

U.S. PATENT DOCUMENTS

| | | | | | |
|---|---|---|---|---|---|
| 1,083,054 | A * | 12/1913 | Brown | 294/58 |
| 1,268,734 | A * | 6/1918 | Lay | 403/66 |
| 2,140,165 | A * | 12/1938 | Plitt | 294/34 |
| 4,225,104 | A * | 9/1980 | Larson | 248/125.8 |
| 4,276,675 | A * | 7/1981 | Pioch | 16/426 |
| 4,881,294 | A * | 11/1989 | Riedl | 16/426 |
| 6,553,627 | B1 * | 4/2003 | Horler | 16/426 |
| 6,751,827 | B1 * | 6/2004 | Fok | 16/413 |
| 6,814,156 | B2 * | 11/2004 | Dieterle et al. | 173/170 |
| 6,863,479 | B2 | 3/2005 | Frauhammer et al. | |
| 7,198,188 | B2 * | 4/2007 | Dion et al. | 227/110 |
| 2002/0121155 | A1 * | 9/2002 | Wu | 74/551.7 |
| 2007/0209162 | A1 | 9/2007 | McRoberts et al. | |
| 2007/0289103 | A1 * | 12/2007 | Steelman | 16/426 |
| 2009/0000434 | A1 * | 1/2009 | Shinma et al. | 81/491 |

FOREIGN PATENT DOCUMENTS

DE 86 21 430 12/1987

(Continued)

*Primary Examiner*—Victor Batson
*Assistant Examiner*—Matthew Sullivan
(74) *Attorney, Agent, or Firm*—Michael J. Striker

(57) ABSTRACT

The invention relates to an additional hand grip (2) for a hand machine tool, comprising a clamp (4) for clamping the additional hand grip (2) to a part of the hand machine tool, a handlebar (6) for gripping and holding of the additional hand grip (2), and a pivot joint (8) that can be blocked, arranged between the clamp (4) and the handlebar (6). The pivot joint (8) can be blocked with an eccentric tension lever (10), which is formed by a pivotable part (24) of the handlebar (6).

12 Claims, 4 Drawing Sheets

FOREIGN PATENT DOCUMENTS

| | | |
|---|---|---|
| DE | 86 21 436 | 12/1987 |
| DE | 39 21 752 | 1/1991 |
| DE | 201 15 631 | 2/2002 |
| DE | 101 30 548 | 1/2003 |
| EP | 1 074 351 | 2/2001 |
| EP | 1 400 317 | 3/2004 |
| JP | 2000176864 | 6/2000 |
| WO | 01/19228 | 3/2001 |

* cited by examiner

AUXILIARY HANDLE WITH ECCENTRIC CLAMPING LEVER FOR A HAND-HELD POWER TOOL

The present invention relates to an auxiliary handle for a hand-held power tool, according to the preamble of Claim 1.

RELATED ART

An auxiliary handle for a hand-held power tool is made known in FIGS. 4 and 5 of DE 101 30 548 A1 which belongs to the applicant, that is fixedly clamped to a part of a rotary hammer using a clamp, includes a handlebar for gripping and holding the auxiliary handle, and that includes a pivot joint located between the clamp and the handlebar.

In addition, the applicant already offers and sells auxiliary handles of the type described initially, with which the pivot joint may be blocked by using the fixing T-handle and a clamping screw, to fix the handle relative to the clamp in a desired pivot position around the pivot axis of the pivot joint, and to fix the clamp relative to the machine tool in a desired rotational position around the center of a circle formed by the clamp. The fixing T-handle includes an internally threaded bore, in which an end—which includes an external thread—of the clamping screw engages, the clamping screw extending along the pivot axis of the pivot joint through flush openings in three joint sleeves of the auxiliary handle that enclose the pivot axis. The two outer joint sleeves are non-rotatably connected with the handle, while the inner joint sleeve—which is divided into two in the axial direction via a slotted opening in the clamp—is non-rotatably connected with the clamp.

By tightening the fixing T-handle, the two outer joint sleeves may be pressed via their inwardly facing, toothed ends against the adjacent end of the inner joint sleeve, which has complementary toothing. When the pivot joint is blocked, the opposing teeth engage in a form-fit manner and prevent the handle from swiveling relative to the clamp when a large pressing force is applied to the handlebar, e.g., when an operator is working with the hand-held power tool. Since the teeth are designed to be extremely rough, i.e., with a tooth height of approximately 2.5 mm, adjacent joint sleeves must be moved apart by at least this amount before the handlebar may be displaced, to prevent the handle from accidentally becoming displaced when the pivot joint is blocked, and to prevent the wear that would result on the teeth that are pressed together. To this end, the fixing T-handle must cover a displacement path of more than 5 mm, which corresponds to several rotations of the fixing T-handle, which many craftsmen consider to be too tedious. Further perceived disadvantages are that the operator is unable to use the fixing T-handle—which extends beyond an end of the pivot joint—during operation of the hand-held power tool, that the fixing T-handle is not particularly aesthetically pleasing, and that it may even hinder handling of the hand-held power tool in tight conditions.

The object of the present invention, therefore, is to improve an auxiliary handle of the type described initially such that it does not include projecting parts that interfere with work and detract from the appearance, and that a component of the auxiliary handle that is already present and also performs another function may be used to displace the handlebar with a minimum of effort.

DISCLOSURE OF THE INVENTION

This object is attained according to the present invention in that the pivot joint is blockable using an eccentric clamping lever that is designed as a swivelable part of the handlebar.

Similar to the fixing T-handle of the known auxiliary handle, the eccentric clamping lever serves to block the pivot joint and, simultaneously, to tighten the clamp, and, by swiveling it in the opposite direction, to release the pivot joint and loosen or release the clamp before the handlebar is displaced relative to the clamp and/or before adjusting the clamp and, therefore, the entire auxiliary handle, relative to the hand-held power tool.

According to a preferred embodiment of the present invention, the pivot joint includes at least one articulated part that is non-rotatably connected with the clamp, and at least one articulated part that is non-rotatably connected with the handlebar, the two articulated parts being rotatable relative to each other around a pivot axis of the pivot joint in order to displace the handlebar, and which may be pressed against each other to block the pivot joint by swiveling the eccentric clamping lever in the axial direction of the pivot axis.

Advantageously, the handlebar and the handlebar of the known auxiliary handle include a yoke part that is located opposite to the pivot joint and is parallel to the pivot axis, and two leg parts that connect the yoke part with the pivot joint. In contrast to the known auxiliary handle, one of the two leg parts is swivelable and serves as the eccentric clamping lever.

According to a further preferred embodiment of the present invention, the eccentric clamping lever is brought into form-fit engagement with the yoke part and is optionally snapped in place with the yoke part when it is swiveled into a position that is parallel with the other leg part in order to block the pivot joint. In this position, the free end of the eccentric clamping lever engages seamlessly in the yoke part of the handlebar, so that it encloses a grip opening on all sides and serves as a stable unit during operation of the hand-held power tool.

The eccentric clamping lever is preferably hingedly connected to a clamping bolt that extends in the axial direction of the pivot axis of the pivot joint through openings in the articulated parts and pulls them together when the eccentric clamping lever is swiveled. As a result, at least two diametrically opposed sets of teeth on adjacent contact surfaces of two articulated parts of the pivot joint that are non-rotatably connected with the clamp and/or the handlebar are brought into a form-fit, toothed engagement, thereby blocking the articulated parts relative to each other. When the eccentric clamping lever is swiveled in the opposite direction in order to displace the handlebar or rotate the clamp to release the blocked pivot joint or expand the clamp, the articulated parts may be moved so far apart from each other in the axial direction of the pivot axis that the diametrically opposed teeth may slide past each other. A total of only pair of diametrically opposed teeth is preferably provided, to avoid having to move the articulated parts apart from each other to a considerable extent before the articulated parts of the handlebar and the articulated parts of the clamp may be rotated relative to each other.

Advantageously, the eccentric clamping lever is hingedly connected to the clamping bolt as an extension of the pivot axis of the pivot joint, and it is provided with a pressing surface that is eccentric to its rotational axis, and that moves along an opposite pressing surface of an adjacent articulated part when the eccentric clamping lever is swiveled around the rotational axis, thereby ensuring that the articulated part moves in the axial direction of the pivot axis of the articulated joint.

To ensure that the free end of the eccentric clamping lever may always be engaged seamlessly with the yoke part of the handlebar, regardless of the pivot position of the handlebar that is selected relative to the clamp, the clamping bolt is non-rotatably connected with the handlebar, thereby enabling the eccentric clamping lever—which is hingedly connected to the clamping bolt—to be displaced along with the handlebar when it is displaced.

BRIEF DESCRIPTION OF THE DRAWING

The present invention is described in greater detail below with reference to an exemplary embodiment shown in the drawing.

EMBODIMENTS OF THE INVENTION

Figure 1:
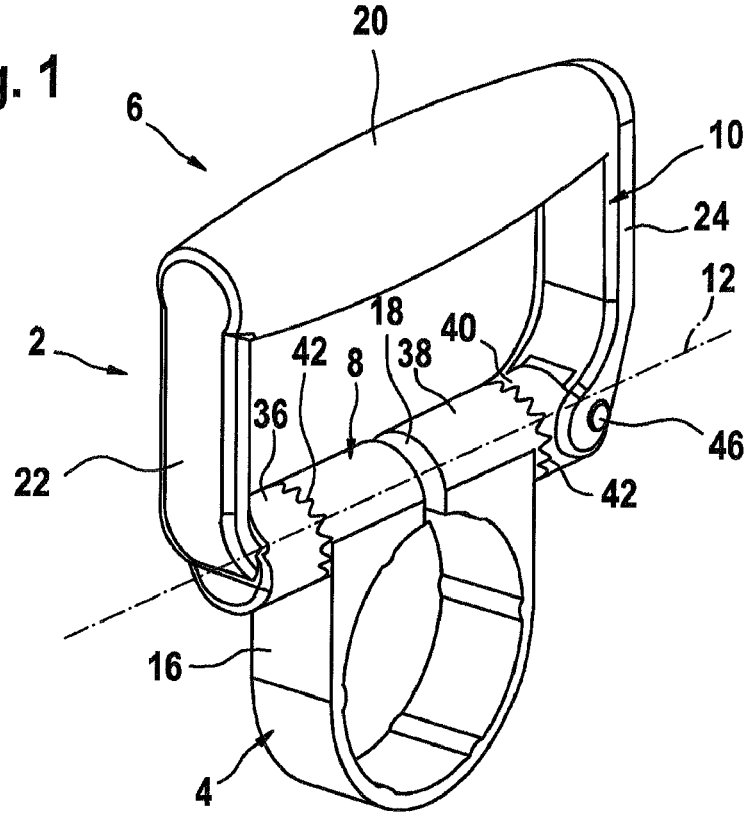
FIG. 1 shows a perspective view of an auxiliary handle for a machine tool with a clamp, a handlebar, a blockable pivot joint between the clamp and handlebar, and an eccentric clamping lever for blocking the pivot joint.
Figure 2:
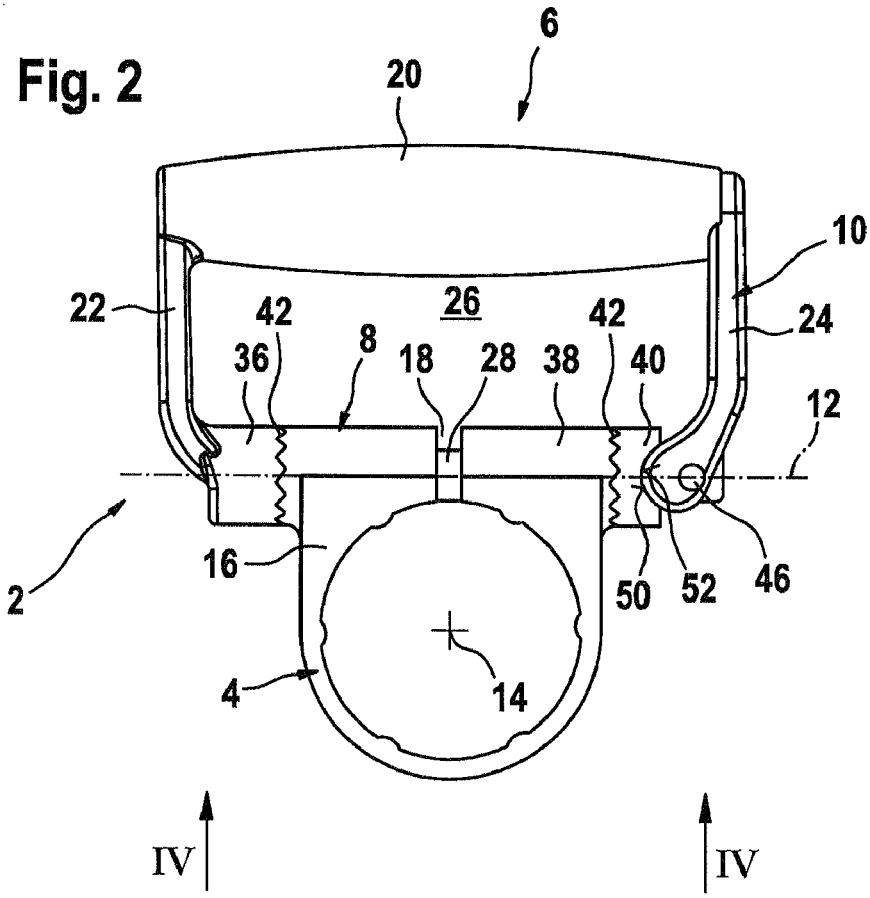
FIG. 2 shows a front view of the auxiliary handle with the pivot joint blocked.
Figure 3:
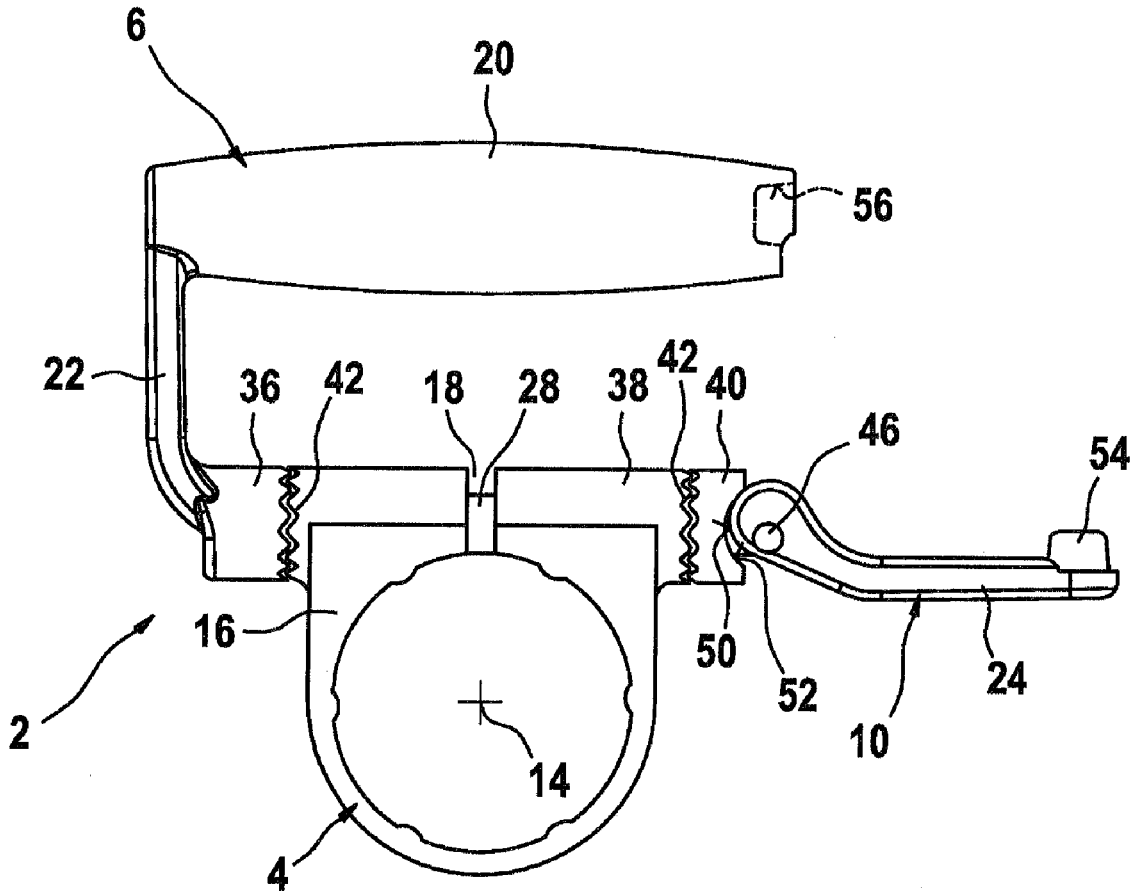
FIG. 3 shows a front view of the auxiliary handle, after the eccentric clamping lever has been displaced in order to loosen the clamp and displace the handlebar relative to the clamp.
Figure 4:
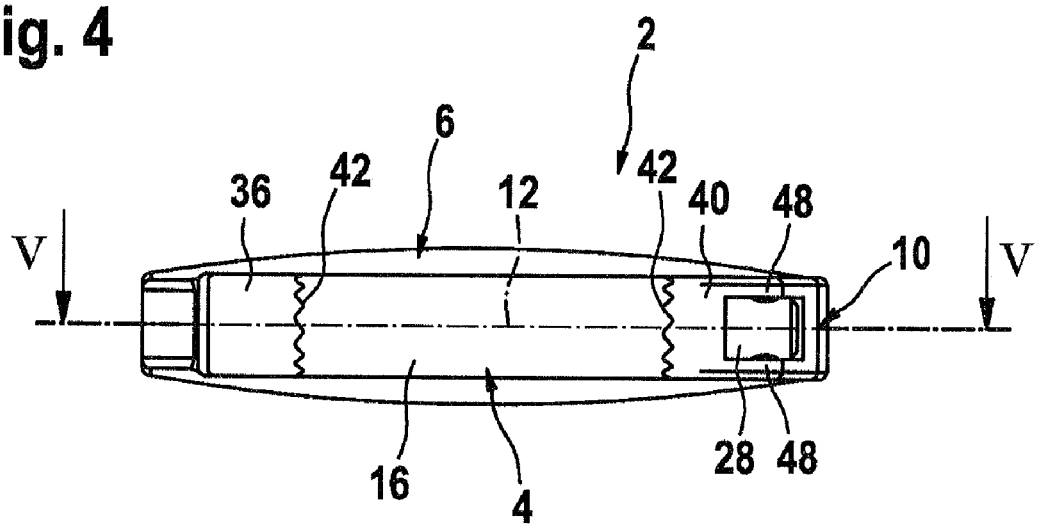
FIG. 4 is a side view of the auxiliary handle in the direction of arrows IV-IV in FIG. 2.

Auxiliary handle 2—shown in the drawing—for use with hand-held power tools, such as drills, rotary hammers, or the like, includes a clamp 4, with which auxiliary handle 2 may be fixedly clamped to a cylindrical part (not shown) of the housing of the machine tools, e.g., a cylindrical shank part behind a tool fitting on drills or rotary hammers, a handlebar 6, at which auxiliary handle 2 may be gripped by an operator, a blockable pivot joint 8 located between clamp 4 and handlebar 6, with which the operator may select a desired pivot setting of handlebar 6 relative to clamp 4 and/or a desired rotational position of clamp 4 and, therefore, of entire auxiliary handle 2 relative to the cylindrical part of the machine tool equipped with auxiliary handle 2. Auxiliary handle 2 also includes an eccentric clamping lever 10, with which pivot joint 8 may be blocked and clamp 4 may be tightened, in order to lock handlebar 6 in a previously selected pivot position around a pivot axis 12 of pivot joint 8 relative to clamp 4, and to lock clamp 4 in a previously selected rotational position around its central axis 14 relative to the machine tool.

Figure 5:
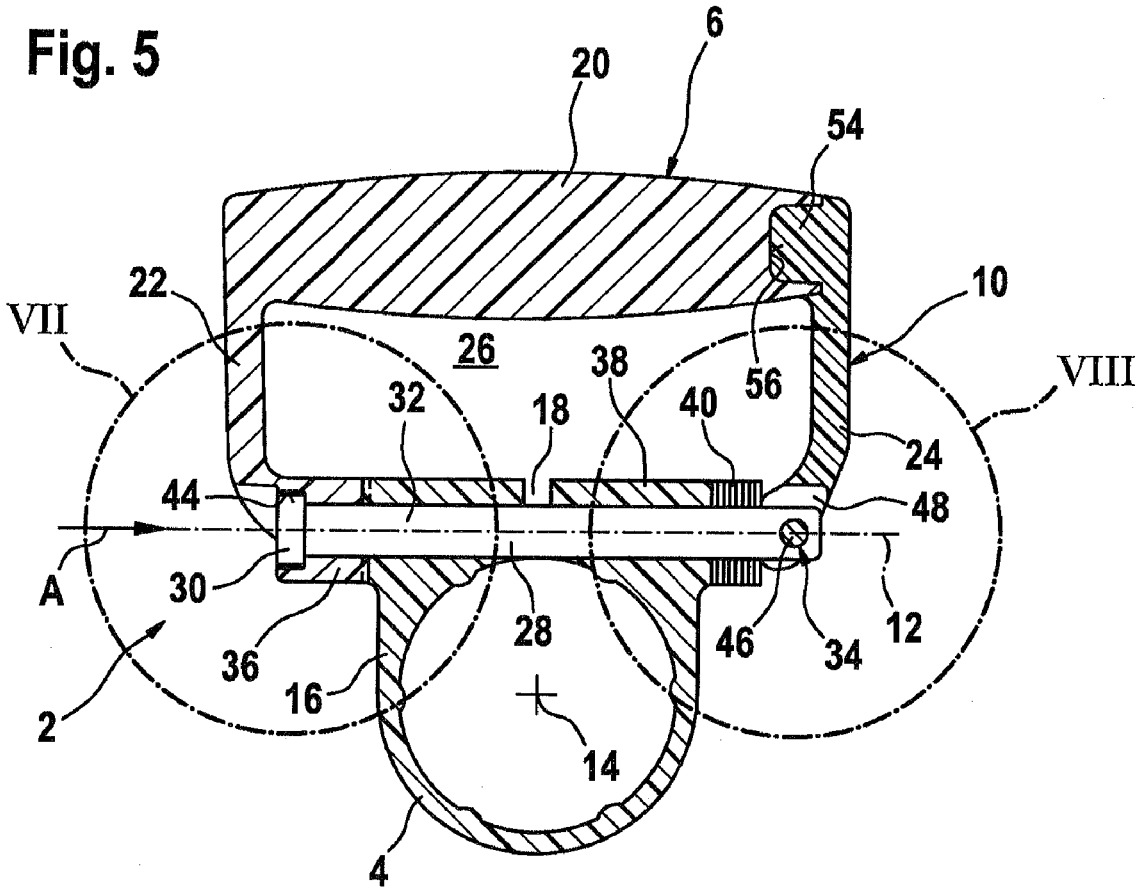
FIG. 5 is a side view of the auxiliary handle along the line V-V in FIG. 4.

As best shown in FIG. 5, clamp 4 is composed of a shaped plastic part 16 that is manufactured as a single piece via injection molding and is designed as a ring that is open on one side, which is provided with a slotted opening 18 that points toward handlebar 6. The width of slotted opening 18 may be changed by actuating eccentric clamping lever 10, in order to tighten clamp 4 by reducing its diameter, for fixation on the machine tool, and to remove or loosen the tightened, tensioned clamp 4 by increasing its diameter.

Handlebar 6 is composed essentially of a yoke part, which is used for gripping and is essentially parallel to pivot axis 12 of pivot joint 8, and two leg parts 22 and 24, one (22) of which is rigidly connected with yoke part 20, while the other (24) serves as swivelable eccentric clamping lever 10 that is used to block pivot joint 8. When pivot joint 8 is blocked, the two leg parts 22 and 24 are oriented essentially parallel to each other and enclose—along with yoke part 20 and pivot joint 8—a grip opening 26 for the hand of the operator that has been placed around yoke part 20.

Pivot joint 8 is composed essentially of a cylindrical clamping bolt 28 with an expanded, hexagonal head part 30 (FIG. 5), a cylindrical shank part 32, and a transverse bore 34 in the end—that is diametrically opposed to head part 30—of shank part 32, and of three plastic joint sleeves 36, 38, 40, which enclose clamping bolt 28. Two outer joint sleeves 36, 40 are located on diametrically opposed sides of pivot joint 8 and are non-rotatably connected with handlebar 6, while an inner joint sleeve 38—which is divided in two by slotted opening 18—is designed as a single piece with plastic part 16 of clamp 4 and extends on both sides of slotted opening 18 to adjacent outer joint sleeve 36 or 40.

When pivot joint 8 is blocked, to prevent handlebar 6 from accidentally swiveling relative to clamp 4 due to a pressing force applied to handlebar 6, it is provided with the exemplary embodiment shown in FIGS. 1 through 5 to provide the outwardly facing ends of inner joint sleeve 38 and the adjacent, inwardly facing ends of the two outer joint sleeves 36 and 40 with complementary tooth systems 42. Tooth systems 42 are composed of a plurality of radial teeth that extend from a cylindrical opening for clamping bolt 28 to a cylindrical outer circumferential surface of joint sleeve 36, 38, 40, extend axially beyond their ends, and are separated by complementary tooth gaps.

Tooth systems 42 may therefore engage essentially without play when—in a plurality of discrete setting positions of handlebar 6 relative to clamp 4—the teeth come to bear against the ends of outer joint sleeves 36, 40 via the tooth gaps of the adjacent ends of inner joint sleeve 38, and vice versa.

Expanded head part 30 of clamping bolt 28 is accommodated in a complementary blind hole 44 in joint sleeve 36 that serves as an anti-rotation lock when clamping bolt 28 is slid through joint sleeves 36, 38, 40 in the direction of arrow A in FIG. 5 when the auxiliary handle is installed via its shank part 32, until the end provided with transverse bore 34 extends outwardly beyond joint sleeve 40 on the opposite side of pivot joint 8. As an alternative, clamping bolt 28 could also be embedded via its head part 30 in joint sleeve 36 and thereby be non-rotatably connected with joint sleeve 36 when it is manufactured out of plastic as a single piece with yoke part 20 and leg part 22 via injection molding during manufacture of handlebar 6.

Transverse bore 34 serves to accommodate a pivot pin 46, which may be inserted—when eccentric clamping lever 10 is installed on clamping bolt 28—in flush bores in legs 48 (FIG. 4) of a fork-shaped end of eccentric clamping lever 10, and through transverse bore 34, and may be subsequently staked in order to fix it in position in fork legs 48. The outer diameter of pivot pin 46 is adapted to the inner diameter of transverse bore 34 such that eccentric clamping lever 10—after it has been installed on clamping bolt 28—is rotatable around a rotational axis formed by central axis of transverse bore 34.

The two fork legs 48 of eccentric clamping lever 10 are bounded at their free ends by convex pressing surfaces 50 with cross sections shaped as circular arcs. Pressing surfaces 50 are eccentric to the rotational axis of eccentric clamping lever 10 and each bear against an opposite concave pressing surface 52 on the outside of outer joint sleeve 40. Pressing surfaces 50 of eccentric clamping lever 10 and pressing surfaces 52 of joint sleeve 40 are adapted to each other such that the two outer joint sleeves 36, 40 are pressed together in the axial direction of pivot axis 12 when eccentric clamping lever 10 is swiveled out of the pivot position shown in FIG. 3 and into the pivot position shown in FIG. 1 in order to block pivot joint 8 and fixedly clamp clamp 4 on the hand-held power tool. The two outer joint sleeves 36, 40 are moved apart from each other in the axial direction of pivot axis 12 due to the tension created when clamp 4 is tightened when eccentric clamping lever 10 is moved out of the pivot position shown in FIG. 1 and into the pivot position shown in FIG. 3 in order to displace handlebar 6 relative to clamp 4 and/or to rotate clamp 4 on the hand-held power tool. In the pivot position shown in FIG. 3, tooth systems 42—which are located opposite to each other in pairs—on the ends of joint sleeves 36, 38, 40 may be rotated relative to each other.

To ensure that eccentric clamping lever 10—when in the pivot position shown in FIG. 1—is a stable, closed unit with the rest of handlebar 6 that encloses grip opening 26 on all sides, eccentric clamping lever 10 includes—on its free end—a projection 54 that projects on one side and engages in a complementary recess 56 in the opposite end of yoke part 20 and may snap in place in the recess in order to provide a "seamless" transition between the free end of eccentric clamping lever 10 and yoke part 20.

Figure 6:
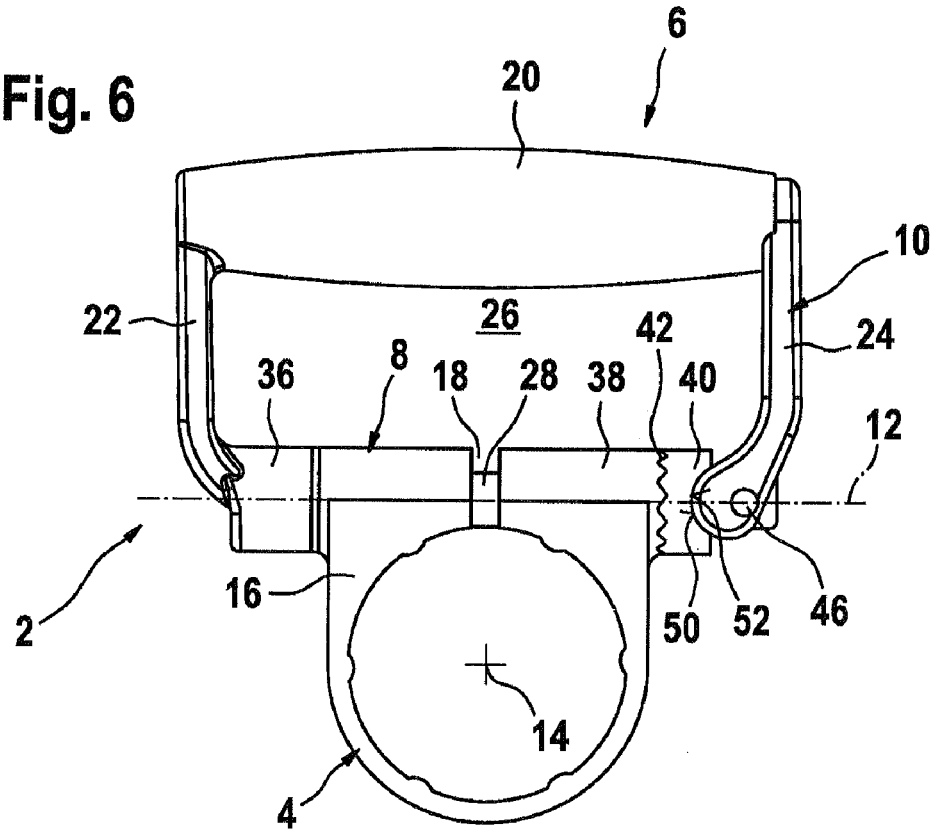
FIG. 6 shows a front view of a modified auxiliary handle with the pivot joint blocked.

In contrast to the exemplary embodiment described above, with the exemplary embodiment described with reference to FIG. 6, only one tooth system 42 is located between adjacent joint sleeves 38 and 40, while the opposite ends of joint sleeves 36 and 38 are not provided with toothing. The amount of axial travel that joint sleeve 40 must cover on clamping bolt 28 until joint sleeves 36 and 40 may be rotated relative to joint sleeve 38 may therefore be reduced by half.

Figure 7:
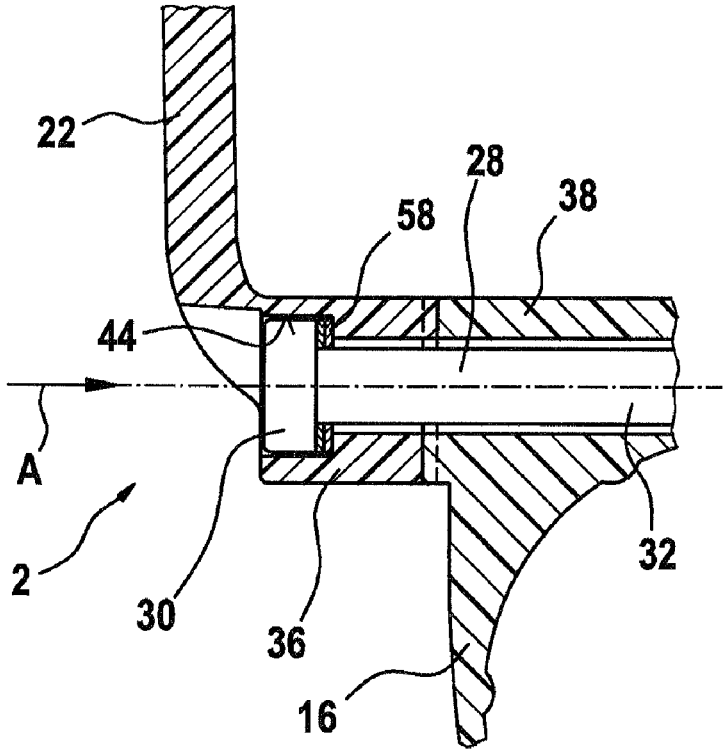
FIG. 7 shows an enlarged sectional view of section VII in FIG. 5, with a device for tolerance compensation.
Figure 8:
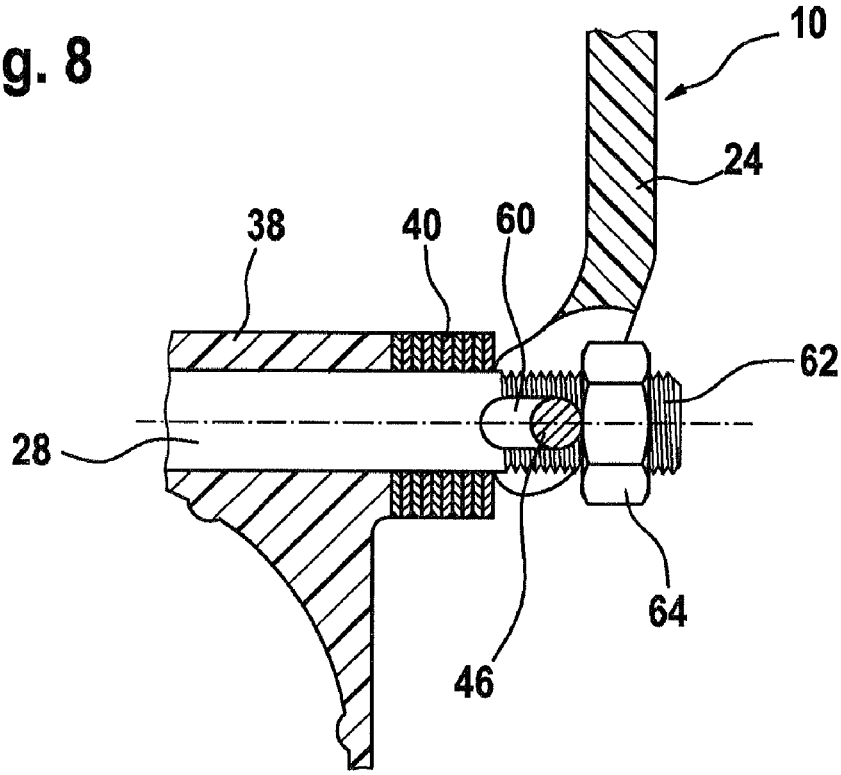
FIG. 8 shows an enlarged sectional view of section VII in FIG. 5, with another device for tolerance compensation.

To compensate for production tolerances of the clamping diameter of the cylindrical part of the hand-held power tool on which clamp 4 is detachably attached via fixed clamping, the effective length of clamping bolt 28 may be changed, as shown in FIGS. 7 and 8.

With auxiliary handles 2 with clamping bolts 28 that are manufactured separately from joint sleeve 36 and are slid through all joint sleeves 36, 38, 40 when auxiliary handles 2 are assembled, one or more spacers 58 is/are inserted—as needed and for this purpose—between head part 30 of clamping bolt 28 and the base of blind hole 44 in joint sleeve 36, as shown in FIG. 7.

With clamping bolts 28 whose expanded head 30 is embedded in the plastic material of joint sleeve 36 during the injection molding of yoke part 20, leg part 22, and joint sleeve 36, the end of clamping bolt 28 that is opposite to head part 30 may be provided not with transverse bore 34 but with a slot 60 that passes through clamping bolt 28, and with an external thread 62 over at least a portion of slot 60. An adjusting nut 64 is screwed onto external thread 62, with which the position of pivot pin 46 of eccentric clamping lever 10 along slot 60 may be adjusted and, therefore, so may the effective length of clamping bolt 28, as shown in FIG. 8.

What is claimed is:

1. An auxiliary handle for a hand-held power tool, comprising a clamp fixedly clamping the auxiliary handle to a part of a machine tool, a handlebar gripping and holding the auxiliary handle, and including a yoke part (20) located opposite to a blockable pivot joint (8) and two leg parts (22, 24) that connect the yoke part (20) with the pivot joint (8), a swivelable eccentric clamping lever (10) blocking the pivot point (8), wherein one of the two leg parts (24) is swivelable and formed entirely by the swivelable eccentric clamping lever and wherein the rotation axes of the blockable pivot joint and the swivelable eccentric clamping lever are perpendicular to each other.

2. The auxiliary handle as recited in claim 1, wherein the pivot joint (8) includes at least one articulated part (38) that is non-rotatably connected with the clamp (4), and at least one articulated part (36, 40) that is non-rotatably connected with the handlebar (6), which are rotatable relative to each other around a pivot axis (12) of the pivot joint (8) in order to displace the handlebar (6), and which may be pressed against each other to block the pivot joint (8) by swiveling the eccentric clamping lever (10) in the axial direction of the pivot axis (12).

3. The auxiliary handle as recited in claim 2, wherein the articulated parts (36, 40; 38), which may be pressed against each other, include diametrically opposed tooth systems (42) on their facing contact surfaces, which engage in each other when the pivot joint (8) is blocked, thereby preventing the articulated parts (36, 40; 38) from rotating relative to each other.

4. The auxiliary handle as recited in claim 3, wherein only one pair of diametrically opposed tooth systems (42) is provided.

5. The auxiliary handle as recited in claim 1, wherein the eccentric clamping lever (10) is engaged with the yoke part (20) in a form-fit manner when the pivot joint (8) is blocked.

6. The auxiliary handle as recited in claim 1, wherein the eccentric clamping lever (10) is provided with a projection (54) on its free end, which engages in a recess (56) of the yoke part (20) when the pivot joint (8) is blocked.

7. The auxiliary handle as recited in claim 1, wherein the eccentric clamping lever (10) includes a fork-shaped end.

8. The auxiliary handle as recited in claim 2, wherein the eccentric clamping lever (10) is hingedly connected to a clamping bolt (28) that extends along a pivot axis (12) of the pivot joint (8) through openings in the articulated parts (36, 38, 40) and pulls the articulated parts (36, 38, 40) together when the eccentric clamping lever (10) is swiveled, in order to block the pivot joint (8).

9. The auxiliary handle as recited in claim 8, wherein the clamping bolt (28) is connected with the handlebar (6) such that it is non-rotatable relative to the pivot axis (12) of the pivot joint (8).

10. The auxiliary handle as recited in claim 2, wherein the eccentric clamping lever (10) is swivelable around a rotation axis located near the pivot axis (12) and is provided with a pressing surface (50) that is eccentric to its rotational axis, which may be pressed against one of the articulated parts (40) by swiveling the eccentric clamping lever (10).

11. The auxiliary handle as recited in claim 1, further comprising means (58; 60, 62, 64) for changing the effective length of the clamping bolt (28) to compensate for production tolerances of the part of the hand-held power tool that serves to attach the clamp (4).

12. An auxiliary handle for a hand-held power tool, comprising a clamp having a central axis (14) and fixedly clamping the auxiliary handle to a part of a machine tool, a handlebar gripping and holding the auxiliary handle, and including a yoke part (20) located opposite to a blockable pivot joint (8) and two leg parts (22, 24) that connect the yoke part (20) with the pivot joint (8), a swivelable eccentric clamping lever (10), blocking the pivot point wherein one of the two leg parts (24) is swivelable and formed entirely by the swivelable eccentric clamping lever and wherein the rotation axes of the blockable pivot joint and the swivelable eccentric clamping lever are perpendicular to each other one of the two leg parts (24), wherein the handlebar (6) is rotatable about a pivot axis (2) which is different from the central axis (14).

* * * * *